US005769552A

United States Patent [19]

Kelley et al.

[11] Patent Number: 5,769,552

[45] Date of Patent: Jun. 23, 1998

[54] FLUID PRODUCT HOLDING AND DISPENSING SYSTEM

[75] Inventors: Matthew F. Kelley, Westport, Conn.; Wayne Young, Brewster, N.Y.

[73] Assignee: Creative Products, Inc., Westport, Conn.

[21] Appl. No.: 643,368

[22] Filed: May 6, 1996

[51] Int. Cl.[6] ..... B05C 17/00; B67B 7/26

[52] U.S. Cl. ..... 401/132; 222/83; 401/134; 604/3

[58] Field of Search ..... 401/132, 134, 401/135; 604/3; 222/83, 83.5, 89

[56] References Cited

U.S. PATENT DOCUMENTS

| | | | |
|---|---|---|---|
| 3,802,604 | 4/1974 | Morane et al. | 401/132 X |
| 4,781,484 | 11/1988 | Goncalves | 401/134 X |
| 4,867,326 | 9/1989 | O'Meara . | |
| 4,898,293 | 2/1990 | Morel . | |
| 4,976,379 | 12/1990 | Sloan . | |
| 5,042,690 | 8/1991 | O'Meara . | |
| 5,120,301 | 6/1992 | Wu . | |
| 5,193,928 | 3/1993 | Balzer et al. | 401/134 X |
| 5,445,462 | 8/1995 | Johnson et al. | 401/132 |

FOREIGN PATENT DOCUMENTS

| | | | |
|---|---|---|---|
| 1757467 | 5/1973 | Germany | 401/134 |

*Primary Examiner*—Steven A. Bratlie
*Attorney, Agent, or Firm*—Melvin I. Stoltz

[57] ABSTRACT

By employing two integrated components which cooperate to achieve a product dispensing trigger assembly, and mounting these two components to a container within which the desired product is retained and on which a desired seal is mounted, a unique fluid product holding and dispensing system is realized. In the present invention, the fluid product holding and dispensing system possesses two separate and distinct locked positions which assures that the system is retained in either locked position, until change is desired by the user. As a result, accidental or unwanted activation of the system is completely eliminated and users are assured that the product retained and sealed in the container remains sealed until use is desired and accidental opening or rupturing of the seal is completely eliminated. In addition, by employing the two-component fluid product holding and dispensing trigger assembly of this invention, an easily manufactured, reasonably priced system is attained which is capable of providing consistent, dependable, repeatable results.

21 Claims, 10 Drawing Sheets

FLUID PRODUCT HOLDING AND DISPENSING SYSTEM

TECHNICAL FIELD

This invention relates to product holding and dispensing containers, and more particularly, to sealed product containers accessible only for use.

BACKGROUND ART

With the ever-increasing addition of new products in the marketplace, substantial attention has been paid to improving product containers, in general, and fluid product holding and dispensing containers, in particular. In this regard, numerous products being sold in a wide variety of channels require the storage of fluid products in a suitable container, with the product being completely sealed within the container prior to use, while also being quickly and easily accessed by the user whenever the products needs to be dispensed.

Due to the wide variety of fluid products sold in the marketplace, numerous fluid product holding and dispensing systems have been created in an attempt to satisfy the variety of applications and needs existing in the marketplace. However, these prior art systems have been incapable of fully and completely meeting all of the requirements imposed upon a fluid product holding and dispensing container.

In particular, the industry has sought a fluid product holding and dispensing container which enables the fluid product to be completely sealed after filling of the container with the sealed container remaining intact until use of the product is desired. Furthermore, when the product is to be used, rapid access to the product is sought without requiring the user to physically rupture the seal in order to attain access to the product.

Although numerous prior art systems have been developed in an attempt to meet the demands of the industry, these prior art systems have been incapable of satisfying the industry demands. In general, these prior art attempt have been incapable of providing completely dependable product holding and dispensing systems which are consistent and repeatable in their performance. Furthermore, these prior art systems generally comprise complex constructions which require numerous components or subassemblies, necessitating costly manufacturing expenses and assembly efforts.

Furthermore, the dispensing of sterilized fluid products represents a major portion of the industry in which holding and dispensing containers are required. However, prior art product holding and dispensing systems have been incapable of satisfying all of the requirements imposed upon systems for holding and dispensing sterilized fluid products.

Therefore, it is a principal object of the present invention to provide a fluid product holding and dispensing system which is capable of being manufactured and shipped with the product completely sealed in a container with that seal quickly and easily ruptured or opened by the user when desired.

Another object of the present invention is to provide a fluid product holding and dispensing system having the characteristic features described above which assures the product remains sealed during shipping and storage, until use is desired.

Another object of the present invention is to provide a fluid product holding and dispensing system having the characteristic features described above which enables the user to quickly and easily activate the system by automatically rupturing or opening the seal to allow the product to be dispensed therethrough.

Another object of the present invention is to provide a fluid product holding and dispensing system having the characteristic features described above which allows all components and products to be fully and completely sterilized prior to distribution.

Another object of the present invention is to provide a fluid product holding and dispensing system having the characteristic features described above which employs a minimum number of components which are easily manufactured and assembled.

Another object of the present invention is to provide a fluid product holding and dispensing system having the characteristic features described above which is usable with virtually any desired product holding container regardless of the size or shape.

Other and more specific objects will in part be obvious and will in part appear hereinafter.

SUMMARY OF THE INVENTION

By employing the present invention, all of the difficulties and drawbacks of the prior art constructions are eliminated and an efficient, easily manufactured, dependable, fluid product holding and dispensing system is attained. By employing the present invention, any desired fluid product is packaged and is completely sealed until use of the product is desired. Once use is desired, the system is activated, causing the seal to be broken or opened, enabling the fluid product to be dispensed.

In the present invention, the fluid product holding and dispensing system possesses two separate and distinct locked positions which assures that the system is retained in either locked position, until change is desired by the user. As a result, accidental or unwanted activation of the system is completely eliminated. Consequently, users are assured that the product retained in the container and sealed will remain sealed until use is desired and accidental opening or rupturing of the seal is completely eliminated.

In order to eliminate the prior art problems which have remained unresolved until the present invention, the present invention employs two integrated components which cooperate to achieve a product dispensing trigger assembly. By mounting these two components to a container within which the desired product is retained and on which a desired seal is mounted, the complete fluid product holding dispensing system is realized.

By achieving a two-component fluid product holding and dispensing trigger assembly, an easily manufactured, reasonably priced system is attained which is capable of providing all of the desired results. Furthermore, the present invention provides a construction which is easily manufactured, is cost effective, and is reliable. As a result, the present invention satisfies all of the needs which prior art constructions have been incapable of attaining.

In the preferred construction of the present invention, any desired fluid product is placed in a generally conventional bottle using generally conventional filling techniques. Once the desired product is fully contained in the bottle, the portal zone of the bottle is sealed with a suitable, flexible seal member, commonly employed in the industry. Although any desired bottle construction and bottle material can be employed for retaining the desired product, viscous products are preferably contained in flexible plastic bottles in order to allow the material to be more easily dispensed by squeezing of the flexible bottle member.

In order to enable the fluid containing bottle to be easily accessed, whenever desired by the user, the product dispensing trigger assembly of the present invention is mounted to the bottle. In the preferred embodiment, the product dispensing trigger assembly of the present invention comprises two components consisting of a cap and guide member and a head or cover member. In the preferred construction, the cap/guide member comprises a threaded portion which is threadedly engaged with the threaded collar of the bottle. This threaded collar defines the portal zone for the bottle, with the remainder of the cap/guide member consisting of an elongated hollow cylindrically shaped portion. In addition, locking means are mounted on the outside wall of the cylindrical portion of the cap/guide member for cooperating with the head or cover.

The second principal component of the product dispensing trigger assembly of the present invention comprises a head or cover portion which is constructed for telescopic, overlying, axially movable interengagement with the cap/guide member. In addition, the head or cover member incorporates lock engaging means formed therewith, positioned for cooperating locking interengagement with the lock members formed on the cap/guide member. In this way, when the cap/guide member is telescopically interengaged with the head member, two alternate locked positions are attainable by moving the head or cover member relative to the cap member.

In addition to incorporating cooperating lock engaging means, the head member also incorporates seal rupturing means integrally formed therewith. In the preferred construction, the seal rupturing means is positioned in juxtaposed spaced relationship with the seal member when the head or cover member is telescopically engaged with the cap/guide member in its first locked position. Whenever the user desires to move the head or cover member relative to the cap/guide member from its first locked position into its second locked position, an actuation force is applied to the cover or head member. This force causes the cover or head member to move relative to the cap/guide member, simultaneously causing seal rupturing means formed in the cover or head member to move therewith into rupturing engagement with the seal member. As a result, the bottle is opened and the fluid product contained therein is accessed.

In addition to providing a rapid, controlled opening of the sealed fluid containing bottle, the product dispensing cover assembly of the present invention is constructed to assure that the two alternate locked positions are maintained, once either position is engaged. Only by positive action of the user is movement from the first locked position to the second locked position attainable. Furthermore, once the product dispensing cover assembly has been placed into its second locked position, disengagement from this position is prevented. As a result, once the fluid containing bottle has been opened by having the seal thereof ruptured, disengagement of the head member from the cap member is prevented, thereby assuring use of all of the fluid product as a one-time product dispensing system.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

In FIGS. 1–15, two alternate embodiments of the fluid product holding and dispensing system of the present invention are fully depicted. These embodiments are presented as representations of alternate constructions that can be employed for attaining the benefits of the present invention. However, the present invention is not limited to these two alternate embodiments and variations thereof can be made without departing from the scope of this invention. Consequently, these embodiments are provided as examples of the present invention and not as limitations thereof.

Figure 1:
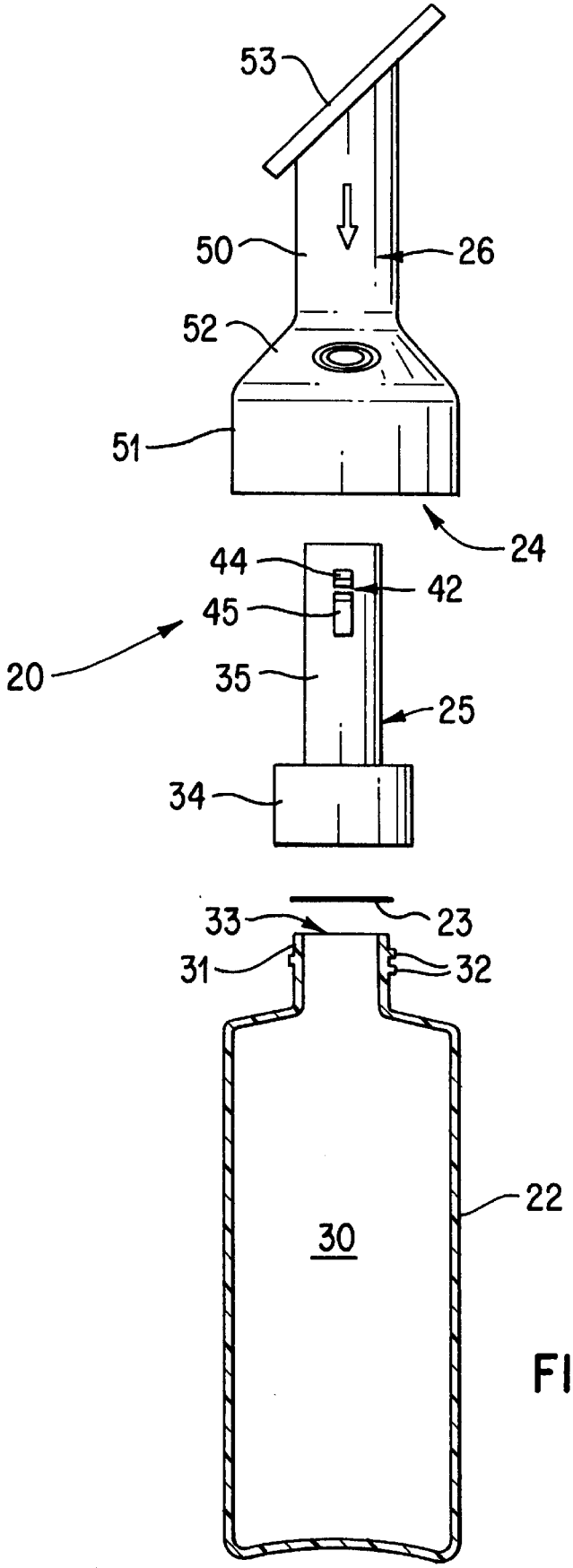
FIG. 1 is an exploded side elevation view, partially in cross-section, depicting each of the components forming the fluid product holding and dispensing system of the present invention.

In FIG. 1, fluid product holding and dispensing system 20 is depicted comprising fluid holding bottle 22, bottle sealing member 23, and product dispensing trigger assembly 24. In this embodiment, product dispensing trigger assembly 24 comprises cap and guide member 25 and head or cover member 26.

As depicted, bottle 22 comprises a generally conventional, cylindrical construction incorporating an internal retaining zone 30 within which the desired fluid product is placed. Bottle 22 comprises a collar 31 which incorporates entry portal 33 for enabling the desired fluid to be inserted into retaining zone 30 as well as removed therefrom. Preferably, upstanding collar 31 also incorporates thread means 32, formed on the outer surface thereof for enabling closure means to be secured thereto.

As discussed above, bottle 22 may comprise any desired size and shape and may be formed from any desired material. For use in the present invention, bottle 22 must only be able to store the desired fluid product in zone 30 and be able to securely receive and retain cap/guide member 25 therewith.

In order to assure that the fluid product placed in retaining zone 30 of bottle 22 is protected from any unwanted contamination, seal member 23 is securely affixed to portal 33 of collar 31. In this way, portal 33 is closed and assurance is provided that the product contained in retaining zone 30 is protected until use.

As clearly shown in FIGS. 1–5 and 9–10, in this embodiment, cap and guide member 25 comprises collar engaging portion 34 and cylindrically shaped tube portion 35. In the preferred construction, collar engaging portion 34 of cap/guide member 25 is constructed for peripherally surrounding and being securely affixed to collar 31 of bottle 22.

Typically, collar engaging portion 34 is dimensioned to correspond with the dimensions of collar 31. As depicted, with collar 31 comprising a cylindrical shape with thread means 32 formed on its outer surface, collar engaging portion 34 incorporates a cylindrical shape with thread means 40 formed on the inside surface thereof, with the inside diameter of collar engaging portion 34 constructed for cooperative, overlying interengagement with collar 31 of bottle 22. In this way, cap/guide member 25 is quickly and easily securely affixed to bottle 22 by threadedly engaging thread means 40 of collar engaging portion 34 with thread means 32 of collar 31 of bottle 22. In this way, cap/guide member 25 is quickly and easily securely mounted to bottle 22 in overlying relationship with portal 33.

In its preferred construction, hollow cylindrical tube portion 35 of cap/guide member 25 is integrally formed with collar engaging portion 34, with the central axis of cylindrical tube portion 35 co-axially aligned with the central axis of cylindrically shaped collar engaging portion 34. In this way, cap/guide member 25 essentially defines and comprises an elongated, centrally located, open, hollow channel 41 integrally formed therein.

The construction of cap/guide member 25 of the present invention is completed by forming lock means 42 and 43 on the outer surface of cylindrical tube portion 35. In the preferred construction, lock means 42 and 43 are formed at diametrically opposed locations on the outer wall of cylindrical tube 35, with each comprising a pair of radially extending ridges or protrusions 44 and 45. As is fully detailed below, the radially extending ridges 44 and 45 which form lock means 42 and 43 are constructed to provide the two alternate locked positions for head or cover member 26 of product dispensing trigger assembly 24.

By referring to FIGS. 2–7, the construction and cooperative operational interengagement of head or cover member 26 with cap/guide member 25 can best be understood. In the preferred construction, head/cover member 26 comprises an outer surface defining shell or housing preferably formed as a first, elongated, substantially cylindrically shaped central portion 50, a second lower, substantially cylindrically shaped, co-axially aligned portion 51 comprising a diameter greater than first cylindrical portion 50, and an intermediate, interconnecting ramp portion 52 extending from first cylindrical portion 50 and second cylindrical portion 51. In the preferred embodiment, intermediate, ramped portion 52 is constructed for interconnecting and smoothly blending the surface of first portion 50 with the surface of second portion 51.

Finally, the outer surface construction of cover or head member 26 is completed by forming an applicator mounting surface 53 to the terminating end of first cylindrical portion 50. Although the incorporation of applicator mounting surface 53 is preferred, for providing a readily usable surface to which a desired applicator can be mounted in order to assist in the dispensing of the fluid product contained in bottle 22, the actual construction and formation of applicator mounting surface 53 will vary depending upon the contents of bottle 22 and the manner in which the contents thereof is employed. Consequently, the overall construction depicted in FIGS. 1–5, in showing a particular applicator mounting surface 53, is merely exemplary of one particular structure, and any desired applicator surface, or dispensing element can be formed on head or cover member 26, without departing from the scope of this invention.

Similarly, the outer surface of head or cover member 26 can be varied in construction, size, shape, or visual appearance, depending upon a particular application being employed or the particular bottle 22 with which head or cover member 26 is affixed. Although the incorporation of cylindrical portions 50 and 51 with intermediate portions 52 is preferred, for providing a highly visible surface which is easily accessed by the user for cooperatively moving head or cover member 26 relative to cap/guide member 25 as detailed below, alternate constructions can be employed for head or cover member 26 without departing from the scope of this invention.

Figure 3:
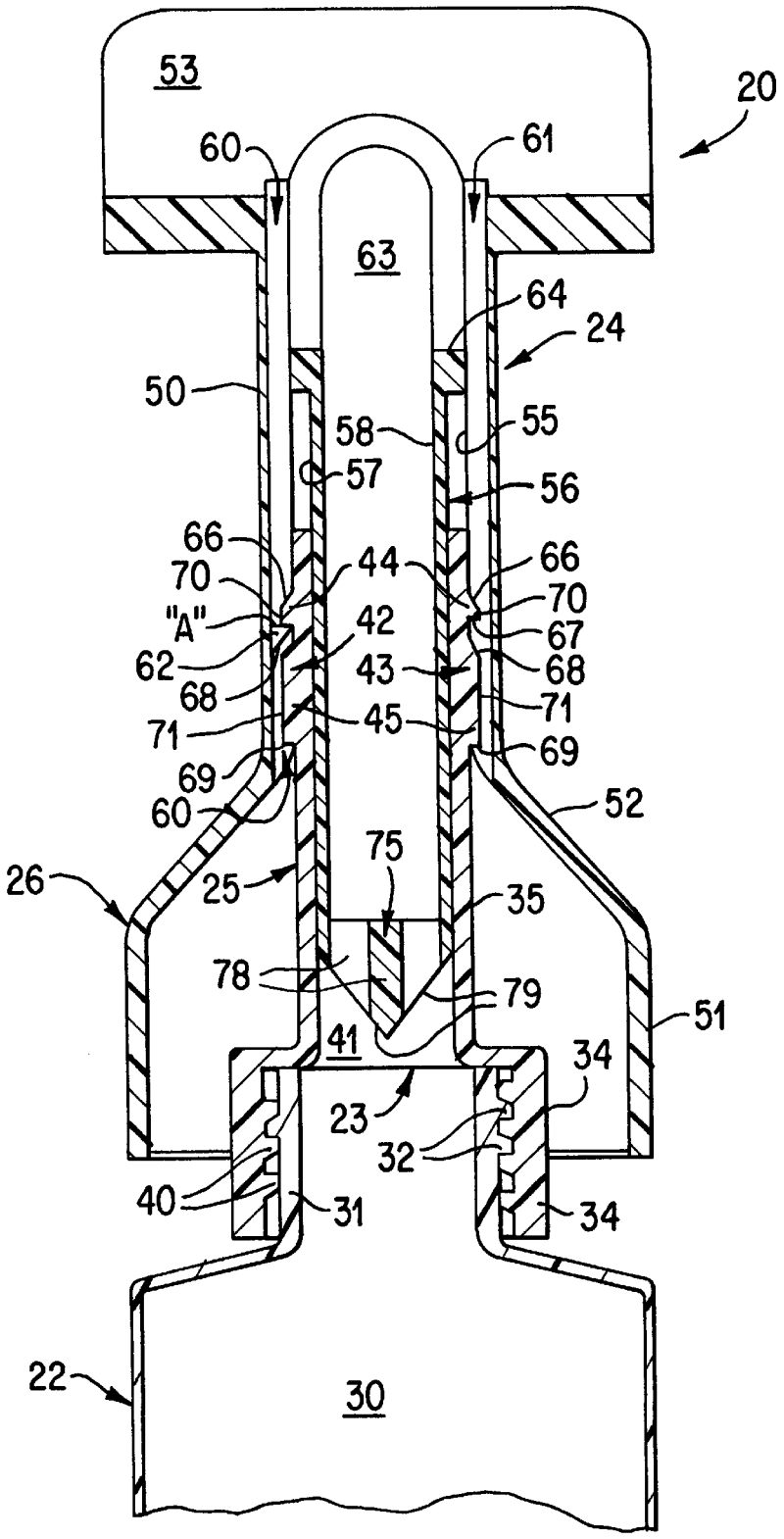
Figure 4:
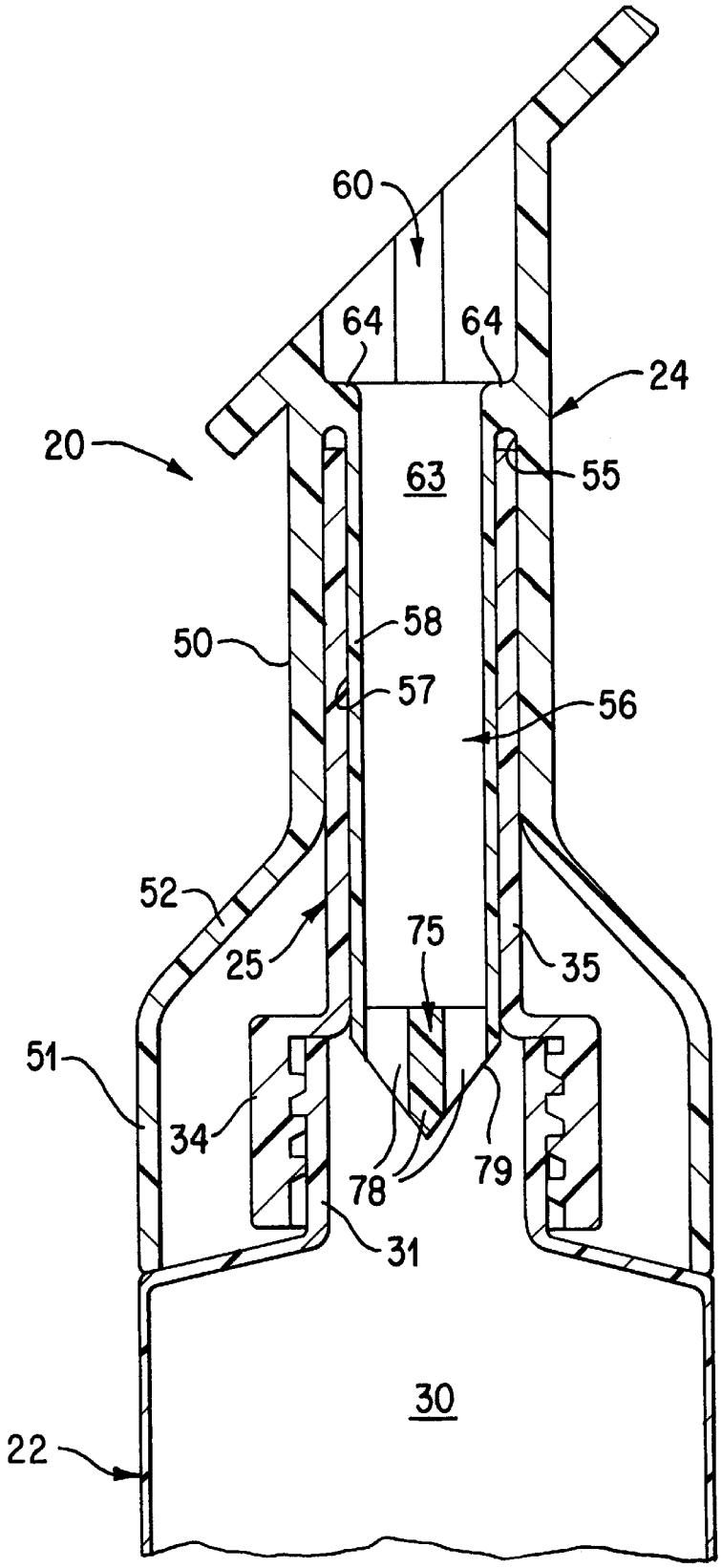
FIGS. 4 and 5 are cross-sectional side elevation views, partially broken away, of the fluid product holding and dispensing system of the present invention depicted in its second locked position.
Figure 5:
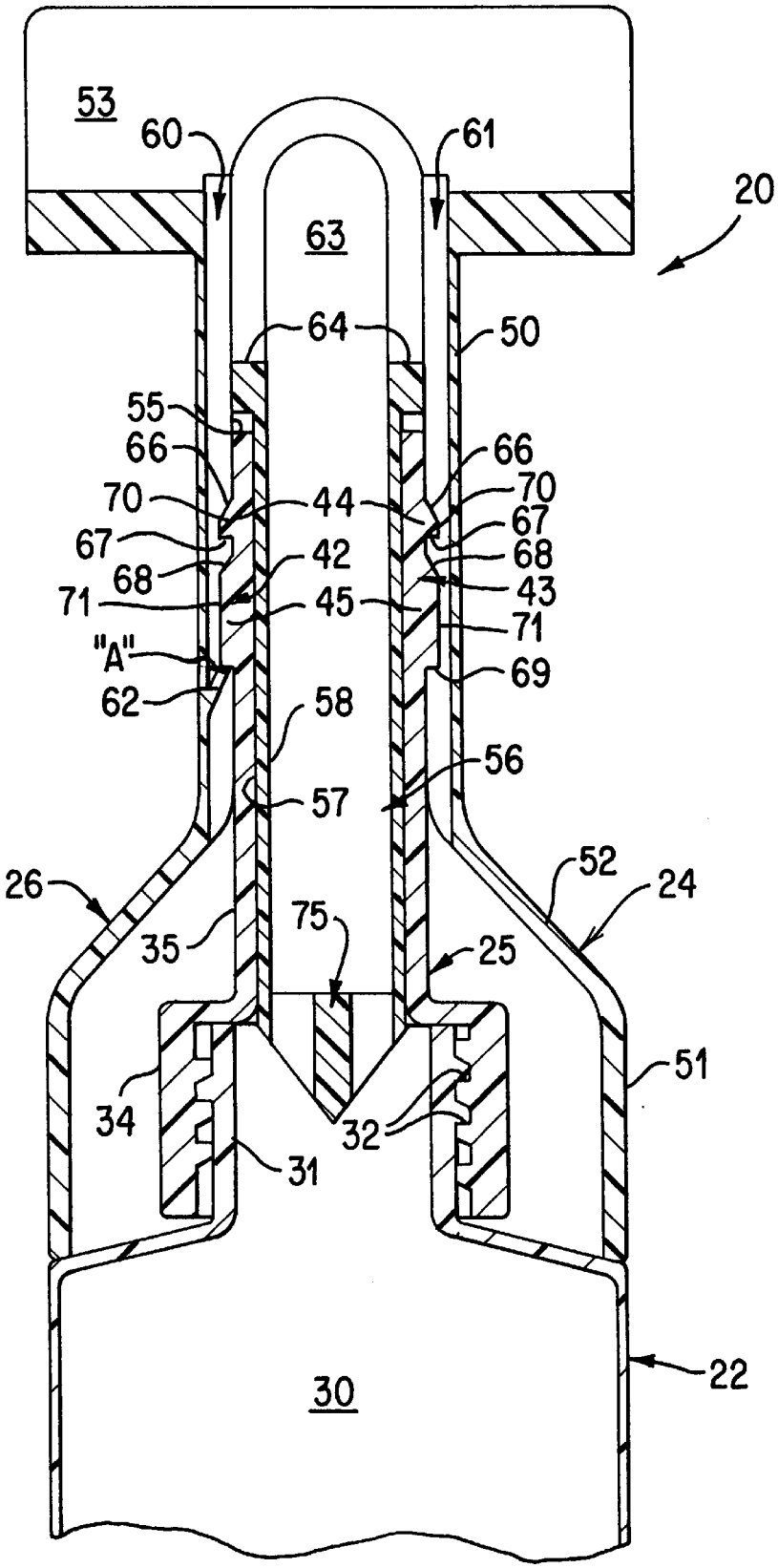
Figure 6:
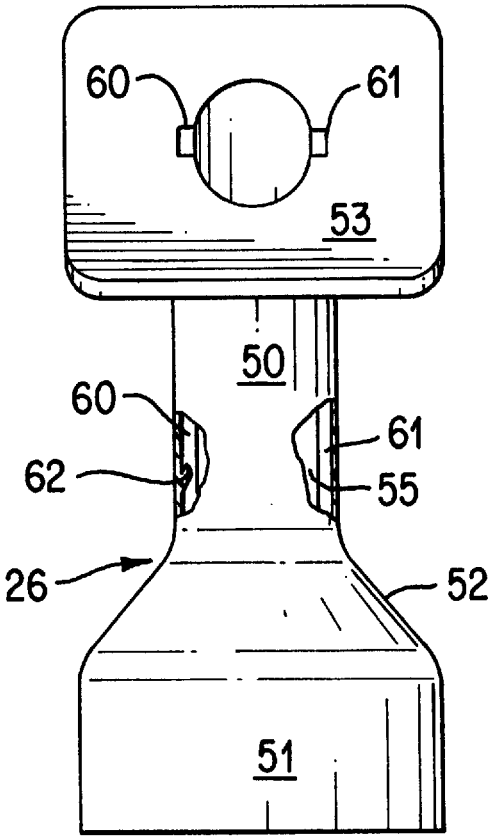
FIG. 6 is a front elevation view of the head or cover member of the fluid product holding and dispensing system of the present invention.
Figure 7:
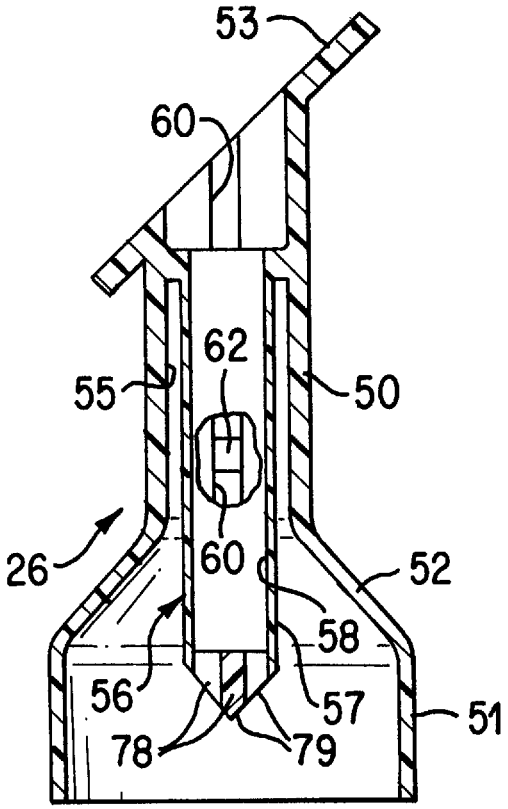
FIG. 7 is a cross-sectional side elevation view of the head or cover member taken along lines 7—7 of FIG. 6.
Figure 8:
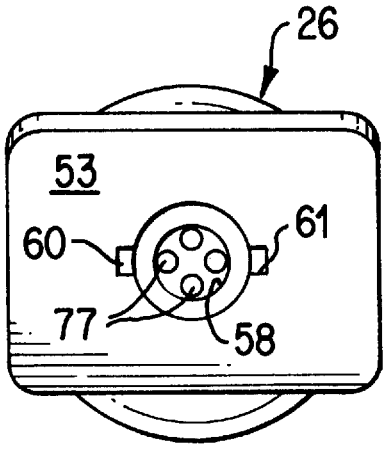
FIG. 8 is a top plan view of the head or cover member of FIG. 6.
Figure 9:
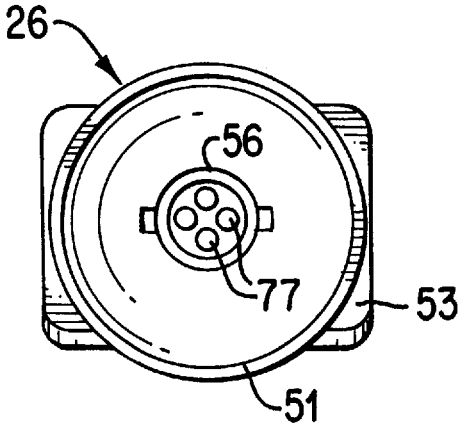
FIG. 9 is a bottom plan view of the head or cover member of FIG. 6.
Figure 10:
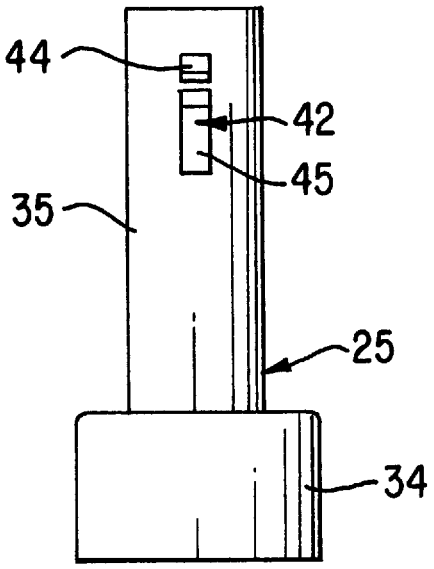
FIG. 10 is a side elevation view of the cap/guide member of the fluid product holding and dispensing system of the present invention.
Figure 11:
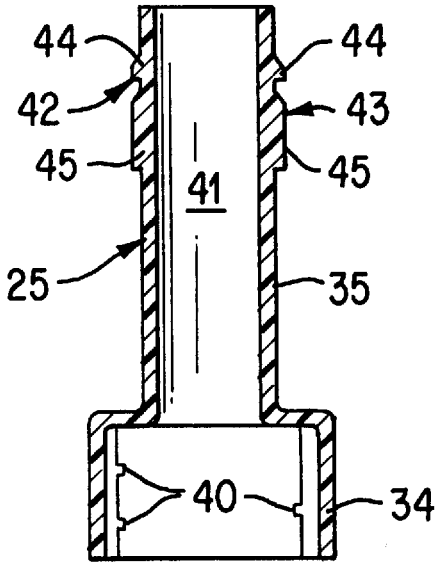
FIG. 11 is a cross-sectional side elevation view of the cap/guide member taken along line 11—11 of FIG. 10.
Figure 12:
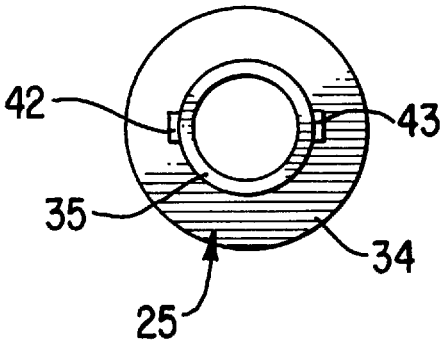
FIG. 12 is a top plan view of the cap/guide member of FIG. 10.

As best seen in FIGS. 3 and 5, first cylindrical portion 50 of head or cover member 26 defines the generally cylindrically shaped outer surface thereof. In addition, first cylindrical portion 50 also incorporates a cylindrically shaped inside wall 55, which is formed with a diameter slightly greater than the diameter of cylindrical tube portion 35. In addition, head or cover member 26 also incorporates a substantially hollow elongated tube member 56 formed co-axially with first cylindrical portion 50 and inwardly spaced from cylindrical shaped inside wall 55.

In the preferred embodiment, elongated, generally hollow centrally disposed tube member 56 comprises an outside wall 57 and an inside wall 58. In this way, inside wall 58 defines an open ended, hollow, product delivery channel 63. Furthermore, tube member 56 is preferably secured to the upper end of first cylindrical portion 50 by support plate 64. In the preferred construction, outside wall 57 of tube member 56 comprises a diameter slightly less than the diameter of elongated central channel 41 of cap/guide member 25 to enable cooperating telescopic engagement therebetween.

As is evident from the foregoing detailed disclosure of the construction of head or cover member 26, an annular cavity is formed between inside wall 55 of first cylindrical portion 50 and outside wall 57 of tube member 56 which is substantially equivalent to the thickness of cylindrical tube portion 35 of cap/guide member 25. In this way, head or cover member 26 is easily telescopically mounted to cylindrical tube portion 35 of cap/guide member 25 in order to enable head or cover member 26 to be telescopically movable relative to cylindrically shaped tube portion 35. In addition, when head or cover member 26 is telescopically mounted to cap/guide member 25, tube member 56 of head and cover member 26 is telescopically engaged and movable within central channel 41 of tube portion 35. In addition, first cylindrical portion 50 of head or cover member 26 peripherally surrounds tube portion 35 and is telescopically axially movable relative thereto.

The telescopic movability and axial interengagement of head or cover member 26 with cap/guide member 25 is clearly depicted in FIGS. 2–5. Furthermore, as detailed below, head or cover member 26 is lockingly interengaged with cap/guide member 25 in its two alternate locked positions as shown in FIGS. 2–5 and fully detailed below.

In order to assure that head or cover member 26 is telescopically movable and lockingly interconnectable with cap/guide member 25, head or cover member 26 incorporates elongated, longitudinally extending grooves 60 and 61 formed in cylindrically shaped inside wall 55 of first cylindrical portion 50. In the preferred construction, grooves 60 and 61 are formed diametrically opposed to each other, with both longitudinally extending substantially the entire axial length of inside wall 55.

In addition, in constructing elongated, longitudinally extending grooves 60 and 61, each groove is constructed with a depth consistent with the radial distance locking means 42 and 43 extend from the outer surface of cylindrical tube portion 35 of cap/guide member 25. In this way, by aligning lock means 42 with groove 60 and aligning lock means 43 with groove 61, longitudinal, axial, telescopic movement of head or cover member 26 relative to cap/guide member 25 is assured.

In order to provide the desired controlled, locking interengagement of head or cover member 26 with cap/guide member 25, head or cover member 26 incorporates at least one locking finger 62 mounted in elongated groove 60. If desired, locking fingers can be mounted in both elongated grooves 60 and 61 in order to provide secure, mating, locked interengagement with both locking means 42 and 43. However, it has been found that the use of at least one locking finger 62 in at least one of the elongated grooves 60 and 61 is sufficient to provide the desired secure, two-position, locking engagement between head or cover member 26 and cap/guide member 25.

In the preferred construction, locking finger 62 is formed radially extending inwardly from the base of groove 60. In addition, locking finger 62 is also constructed to extend inwardly at an acute angle relative to the base of groove 60. Finally, locking finger 62 is formed with an overall thickness and an angular relationship to groove 60 which enables locking finger 62 to be generally rigid and inflexible, while still allowing movement thereof for deflection when sufficient force is applied to locking finger 62. In this way, the cooperating, locking engagement of finger 62 with ridges 44 and 45 of lock means 42 provides the desired two alternate locked positions, while also enabling movement from the first locked position to the second locked position only when desired by the user.

In order to achieve this dual locking interengagement between head or cover member 26 and cap/guide member 25, ridge 44 comprises two cooperating, spaced surfaces formed by sloping surface 66 and flat surface 67 which extends generally perpendicularly from the outer surface of tube portion 35. In addition, intermediate surface 70 extends between and interconnects surface 67 with surface 68 as a generally flat surface formed parallel to the outer surface of tube portion 35.

Similarly, ridge or protrusion 45 incorporates two cooperating spaced surfaces formed by sloping surface 68 and flat surface 69 extending substantially perpendicularly from outer surface of tube portion 35. In addition, intermediate surface 71 extends between and interconnects surface 68 with surface 69 as a generally flat surface constructed generally parallel to the outer surface of tube portion 35.

In the preferred construction, ridge 44 is formed with ramp surface 66 spaced away from perpendicular surface 67 a short distance, while ridge 45 is constructed with sloping surface 68 spaced away from perpendicular surface 69 a substantially greater distance. Both ramped or sloping surfaces 66 and 68 comprise acute angles consistent with angle "A" which defines the acute angle at which locking finger 62 extends from the base of groove 60.

By employing this construction, as head or cover member 26 is telescopically mounted to cap/guide member 25 and axially advanced relative thereto, locking finger 62 first comes into contact with ramp surface 66 of ridge 44. This provides the first resistance to telescopic interengagement of the components, while still allowing the removal of head or cover member 26 from cap/guide member 25.

In order to securely, lockingly, interengage head or cover member 26 with cap/guide member 25, head or cover member 26 is axially advanced into further engagement with cap/guide member 25. Since the slope of locking finger 62 and surface 66 are consistent, or generally co-planar with each other, further movement of head or cover member 26 relative to cap/guide member 25 causes locking finger 62 to deflect a sufficient distance to allow locking finger 62 to contact flat surface 70 and slide thereon until locking finger 62 contacts ramp surface 68 or perpendicular surface 67. Once in this position, head or cover member 26 is securely locked to cap/guide member 25 in its first locked interengaged position, with head or cover member 26 incapable of being removed from cap/guide member 25 due to the inability of locking finger 62 to pass by perpendicular surface 67.

Similarly, sloping surface 68 is in contact with locking finger 62, preventing head or cover member 26 to be easily moved out of the first locked position. Consequently, once locking finger 62 is in this position, assurance is provided that product dispensing trigger assembly 24 is securely maintained in its first locked position, awaiting further action or activation by the user.

In order to enable bottle 22, with seal member 23 securely affixed thereto, to be automatically opened whenever desired by the user, head or cover member 26 comprises seal piercing means 75 integrally formed therewith which automatically ruptures seal member 23 whenever the user desires. In this way, when the product contained in bottle 22 is sought by the user to be employed, the seal rupturing means 75 of head or cover member 26 is activated for rupturing seal member 23. This is achieved by telescopic advancing head or cover member 26 relative to cap/guide member 25 from their first locked position to their second locked position.

In the preferred embodiment, the end of tube member 56 of head or cover member 26, which is positioned adjacent seal member 23, is constructed with cutting or rupturing means 75 formed therein in order to provide the desired opening of bottle 22. In the preferred construction, seal rupturing means 75 comprises a plurality of cutting blades 78, each of which incorporate cutting edge 79. In addition, cutting blades 78 are integrally formed at the lower end of tube member 56, extending downwardly therefrom towards seal member 23. By constructing head or cover member 26 in this manner, the automatic, rapid, and dependable rupturing of seal member 23 is attained, as detailed below.

Figure 2:
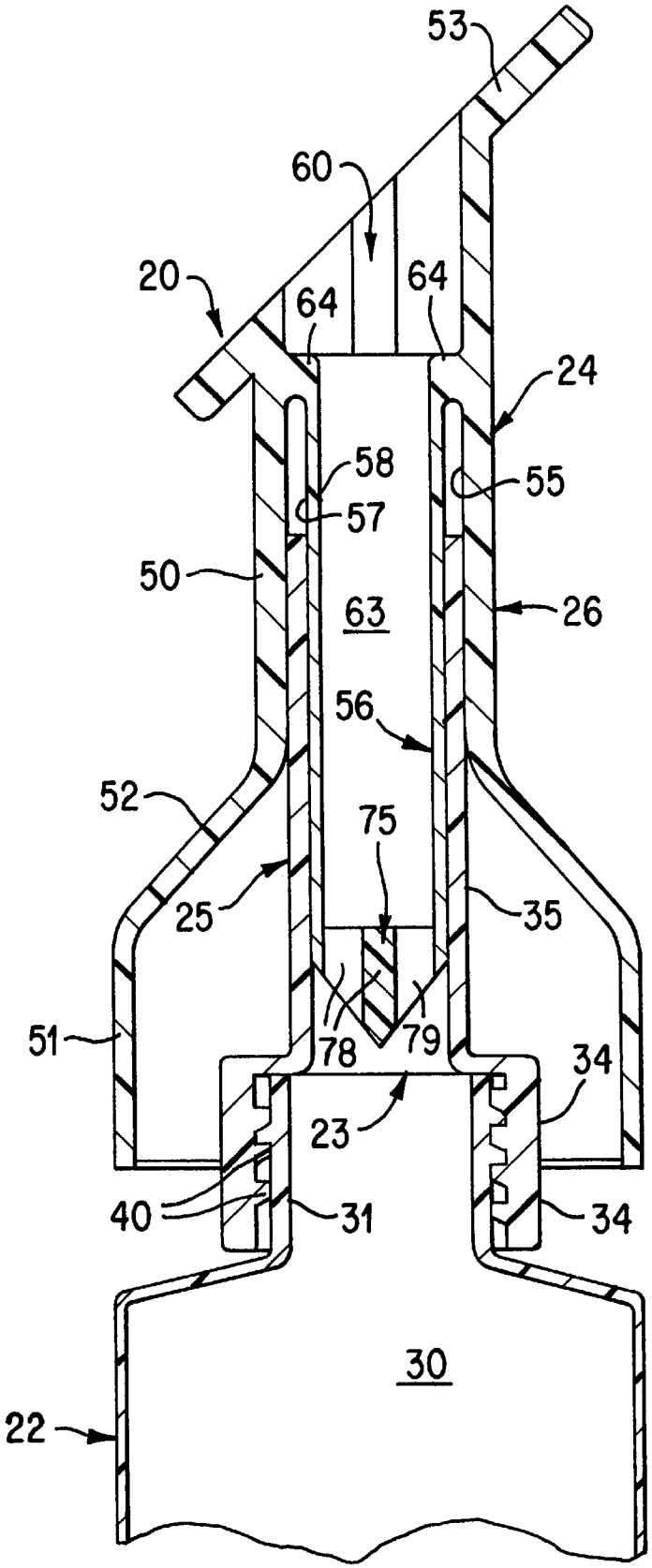
FIGS. 2 and 3 are cross-sectional side elevation views, partially broken away, depicting the fully assembled fluid product holding and dispensing system of the present invention shown in its first locked position.

In FIGS. 2 and 3, the fully assembled fluid product holding and dispensing system 20 of the present invention is depicted with head or cover member 26 securely mounted and maintained to cap/guide member 25 in its first locked position. In this position, head or cover member 26 is incapable of being removed from cap/guide member 25 while also being securely maintained in the first locked position, awaiting further action by the user. In addition, cutting edges 79 of cutting blades 78 are positioned in juxtaposed, spaced relationship to seal member 23, assuring the integrity of seal member 23 as well as the product contained in bottle 22.

Whenever the user is ready to employ the product sealed within bottle 22, the user is able to quickly and easily rupture seal member 23 by imparting an activation force to head or cover member 26 sufficient to cause head or cover member 26 to move axially along cap/guide member 25 to bring product dispensing trigger assembly 24 into its second locked position. Whenever this activation force is imparted to head or cover member 26, the force causes locking finger 62 to come into contact with sloping, ramped surface 68 of ridge or protrusion 45 which initially resists any further telescopic movement of head or cover member 26 relative to cap/guide member 25. However, when sufficient force is applied to head or cover member 26, locking finger 62 is forced to deflect along ramp surface 68 to a position which enables locking finger 62 to arcuately pivot to a position which allows head or cover member 26 to move axially downwardly, while locking finger 62 slides along flat surface 71 of protrusion 45.

This axial, telescopic movement continues until locking finger 62 is free to pivot back to its original position, bringing locking finger 62 into contact with perpendicular surface 69 of ridge 45. When in this position, further downward movement of cover or head member 26 relative to cap/guide member 25 is prevented, due to the abutment of the terminating edge of cylindrical tube portion 35 of cap/guide member 25 with the internal surfaces of cap/guide member 25. In addition, axial movement of head or cover member 26 in the opposite direction relative to cap/guide member 25 is prevented due to the contact of locking finger 62 with surface 69. As a result, once this second position has been attained, secure locked engagement of head or cover member 26 with cap/guide member 25 is produced.

As is evident from the foregoing detailed disclosure regarding cutting blades 78 and cutting edges 79, the telescopic, axial movement of head or cover member 26 relative to cap/guide member 25 to move from the first locked position to the second locked position causes cutting blades 78 to move downwardly towards seal member 23. Before the second locked position is reached, cutting edges 79 of cutting blades 78 contact seal member 23, causing the seal member to be pierced therethrough, effectively rupturing seal member 23 and opening bottle 22 for use.

In the preferred construction, the axial movement of head or cover member 26 with cap/guide member 25 is constructed to assure that seal member 23 is opened in its entirety before the second locked position is reached. This second locked position is clearly shown in FIGS. 4 and 5.

Once product dispensing trigger assembly 24 has been advanced into its second locked position, seal member 23 of bottle 22 is ruptured to enable the user to dispense the contents of bottle 22 in the desired manner. The fluid contained in retaining zone 30 of bottle 22 easily passes through open zones 77 formed between cutting blades 78 into product delivery channel 63 of tube member 66. Once the fluid has traveled through delivery channel 63, the desired fluid exits therefrom onto the particular applicator mounted to mounting zone 53. In this way, the product can be applied in the desired manner as the user wishes.

As is evident from the foregoing detailed disclosure, fluid product holding and dispensing system 20 of the present invention provides a reliable, easily employed, repeatable construction which enables any desired fluid product retained in bottle 22 to be dispensed therefrom whenever desired by the user, with assurity that the product is only dispensed when so desired. As detailed above, all of the drawbacks found in prior art constructions have been overcome by this embodiment of the present invention and a unique, easily employed, dependable, fluid product holding and dispensing system is realized.

Figure 13:
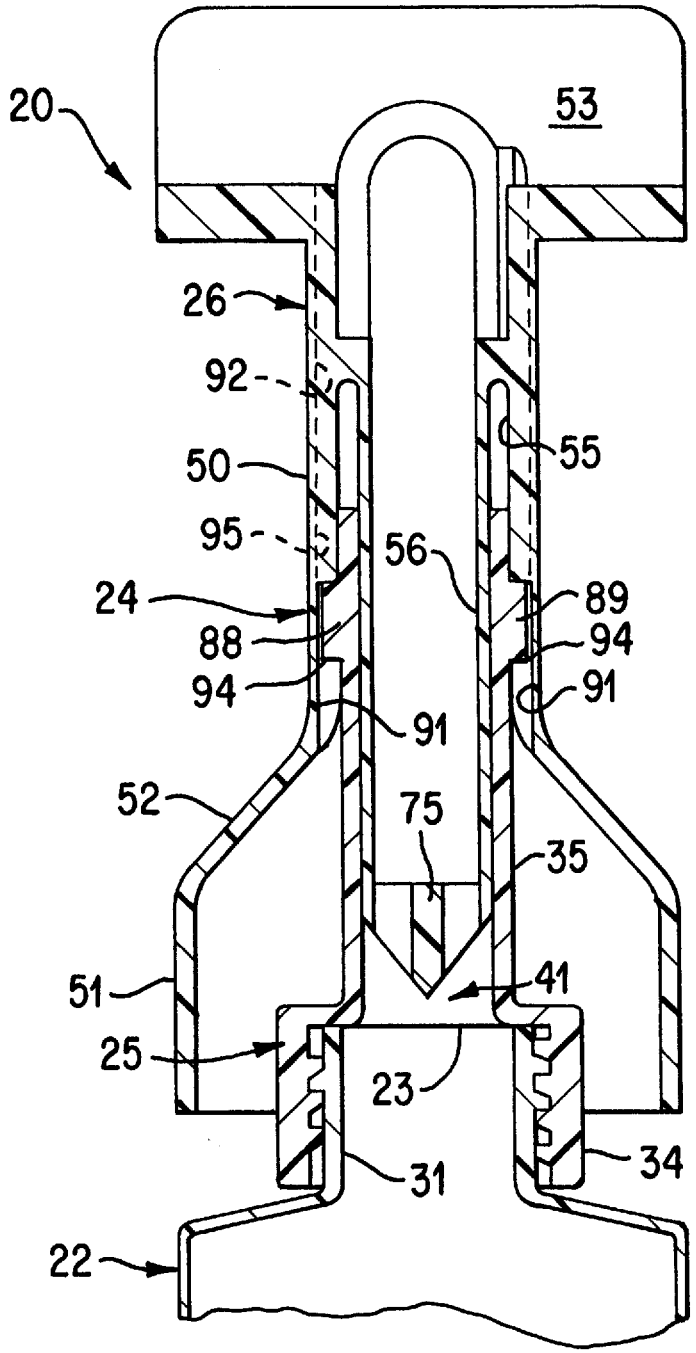
FIG. 13 is a cross-sectional side elevation view, partially broken away, depicting an alternate embodiment of the fully assembled fluid product holding and dispensing system of the present invention shown in its first locked position.
Figure 14:
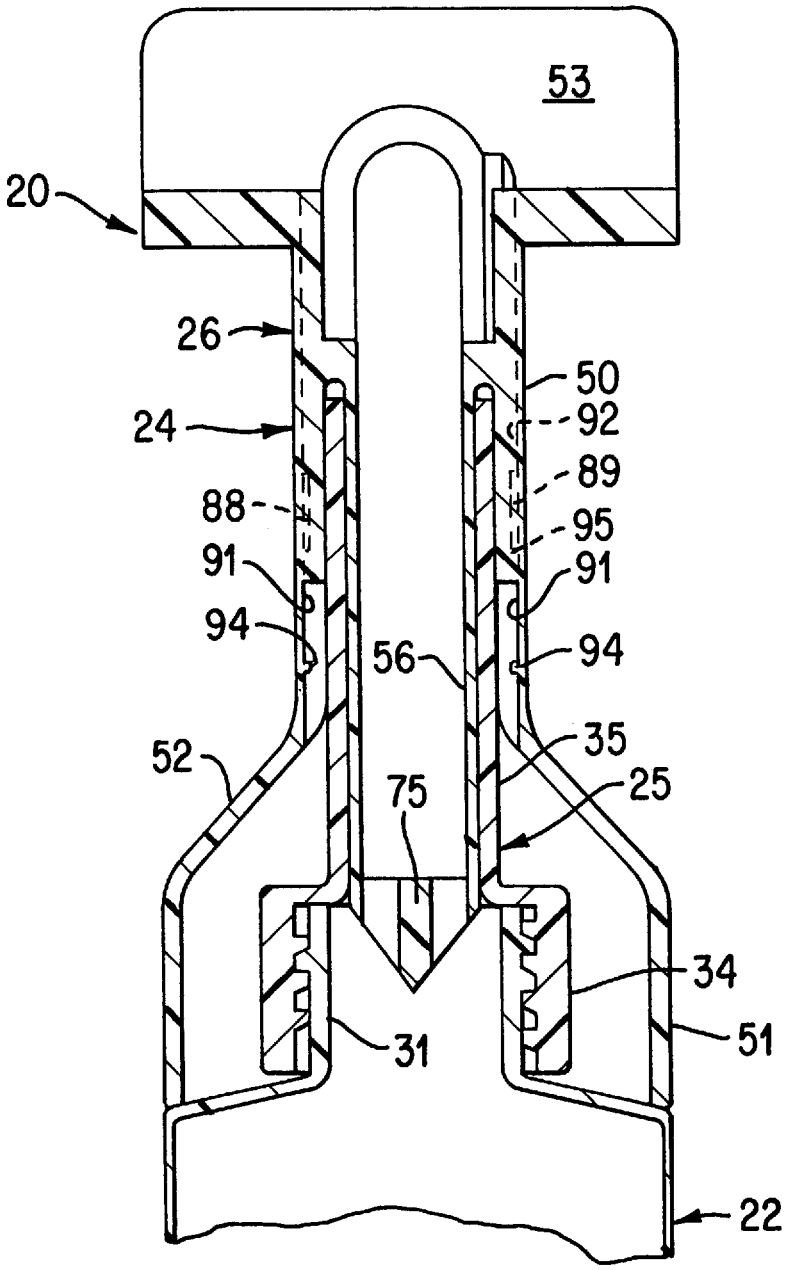
FIG. 14 is a cross-sectional side elevation view, partially broken away, depicting the embodiment of FIG. 13 in its second locked position.
Figure 15:
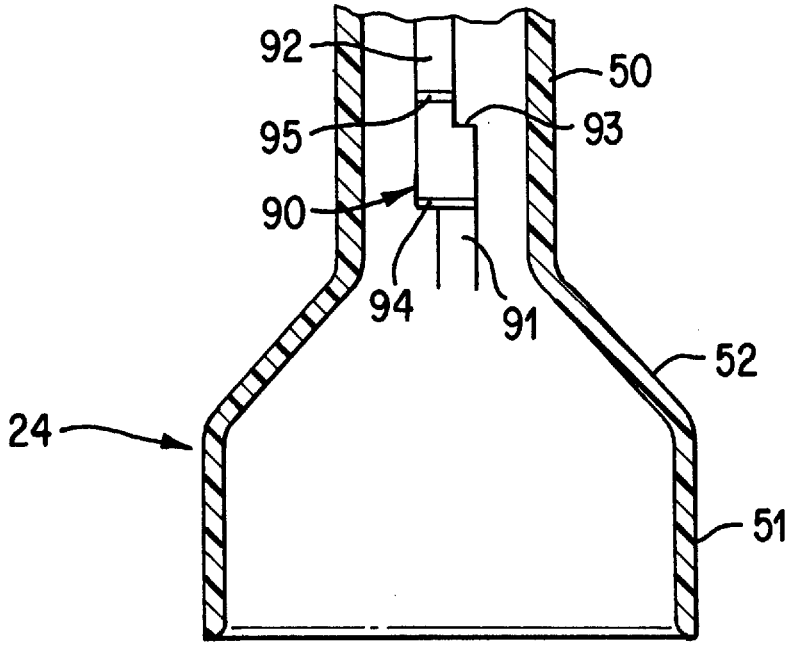
FIG. 15 is a side elevation view, partially in cross-section, and partially broken away, of the inside wall of the head or cover member of the embodiment of FIG. 13.

In FIGS. 13, 14, and 15, an alternate embodiment of the fluid product holding and dispensing system 20 of the present invention is depicted. In this embodiment, fluid product holding and dispensing system 20 comprises a fluid holding bottle 22, a bottle sealing member 23, and product dispensing trigger assembly 24, all of which are constructed in a manner substantially identical to the embodiment shown in FIGS. 1–12 and fully detailed above. In addition, with the previous embodiment, product dispensing trigger assembly 24 comprises cap and guide member 25 and head or cover member 26. However, as detailed below, in this embodiment, an alternate construction for the locking interengagement of cap and guide member 25 with head or cover member 26 is employed.

Due to the similarity of construction between the embodiment detailed in FIGS. 1–12 and the embodiment shown in FIGS. 13–15, all of the elements of the second embodiment which are identical in construction to the first embodiment are shown using the same reference numerals. In addition, since the overall operation of this second embodiment of fluid product holding and dispensing system 20 is substantially identical to the operation detailed above in the previous embodiment, the similar structure and operational details are not repeated.

In order to provide a product dispensing trigger assembly 24 which is capable of moving between two alternate locked positions, with the user completely controlling the movement of trigger assembly 24 from its first locked position to its second locked position, this embodiment of the present invention incorporates lock or control means 88 and 89 formed on the outer surface of tube portion 35 of cap and guide member 25. In the preferred embodiment, lock or control means 88 and 89 each comprise substantially rectangular shaped extensions formed on the outer surface of tube portion 35, radially extending therefrom for cooperative interengagement with head or cover member 26.

As best seen in FIG. 15, head or cover member 26 incorporates elongated, movement control channel 90 formed in inside wall 55 of first cylindrical portion 50. In the preferred embodiment, elongated channel or groove 90 comprises two axially extending, substantially parallel portions 91 and 92 which are in spaced relationship with each other, and are interconnected by intermediate portion 93. As a result, channel or groove 90 is substantially continuous extending from axial groove portion 91 through intermediate portion 93 to substantially parallel axial groove portion 92.

In addition, channel or groove 90 also incorporates a locking stop or rib 94 formed in groove portion 91 and a similar locking stop or rib 95 formed in groove portion 92. Each stop or rib 94 and 95 comprise rib means extending upwardly from the base of the groove within which it is formed, in order to partially block the open zone of the groove.

As shown in FIGS. 13 and 14, in the preferred construction of this embodiment of the present invention, two movement control channels or grooves 90,90 are formed on opposed sides of the inside wall 55 in juxtaposed, facing relationship with each other. In this way, lock or control means 88 and 89 each cooperate with one of the two channel or grooves 90 for controlling the telescopic movement of head or cover member 26 relative to cap/guide member 25. However, if desired, one pair of these components may be employed without departing from the scope of this invention.

By referring to FIGS. 13 and 14, the two alternate locked positions attainable by this embodiment of product dispensing trigger assembly 24 is depicted. In FIG. 15, product dispensing trigger assembly 24 is shown in its first locked position, with seal rupturing means 75 maintained in juxtaposed, spaced relationship with seal member 23 of bottle 22. In order to attain this position, tube member 56 of head or cover member 26 is positioned within central channel 41 of tube portion 35 of cap/guide member 25, causing cap/guide member 25 to be telescopically engaged with head or cover member 26.

In order to control this telescopic axial, cooperative engagement, lock/control means 88 and 89 are aligned with groove portion 91 of movement control channel 90, thereby enabling lock/control means 88 and 89 to move axially through groove portion 91. In this embodiment, once cap/guide member 25 is mounted in telescopic interengagement with head or cover member 26, lock/control means 88 and 89 are advanced simultaneously through cooperating groove portion 91,91 until the lock/control means 88 and 89 each abut the entry of groove portion 93. This position corresponds to FIG. 13 which represents the first locked position of product dispensing trigger assembly 24.

In order to provide product dispensing trigger assembly 24 with a securely locked configuration when in its first position, stop or rib 94 is formed in groove portion 91 in spaced relationship with the entry to groove portion 93, a distance which enables lock/control means 88 or 89 to be retained therebetween. Once head or cover member 26 has been advanced with stop or rib 94 passing lock/control means 88 and 89, movement of head or cover member 26 in the opposite direction is resisted by the contact of lock/control means 88 and 89 with the abutting stop or rib 94. As a result, product dispensing trigger assembly 24 is maintained in this locked position.

Whenever the user desires to open bottle 22 in order to dispense the product contained therein, head or cover member 26 is rotated relative to cap/guide member 25, causing lock/control means 88 and 89 to move through groove portion 93. When rotated through the full arcuate capability provided by groove portion 93, lock/control means 88 and 89 are aligned with groove portion 92.

In order to complete the access to bottle 22, head or cover member 26 is then telescopically moved downwardly, relative to cap/guide member 25, causing lock/control means 88 and 89 to pass beyond stop or rib 95. Once head or cover member 26 has been telescopically axially moved to the second position, wherein portion 51 abuts bottle 22, seal rupturing means 75 is automatically brought into contact with seal means 23, completely rupturing seal means 23 in order to gain access to bottle 22. In addition, stop or rib 95 is forced passed lock/control means 88, providing a second locked contacting engagement for lock/control means 88 and 89 preventing the reverse movement of head or cover member 26 relative to cap/guide member 25.

Once product dispensing trigger assembly 25 has been moved into its second locked position, as depicted in FIG. 14, the contents contained in bottle 22 is easily dispensed by passage of the product through the open zone formed between cutting blade 78 of seal rupture means 75. Once the product passes through the void zones formed between cutting blades 78, the fluid then travels through the product delivery passageway formed by tube member 56 to be delivered to the particular applicator mounted to surface 53.

As is apparent from the foregoing detailed disclosure of this alternate embodiment, by employing this embodiment of product dispensing trigger assembly 24, the desired, two-position, interlocked construction is attained, with the user being able to quickly and easily move from the first position, wherein the product is sealed within bottle 22, to the second position, wherein the product contained in bottle 22 is easily dispensed. As a result, by employing this embodiment of the present invention, all of the objects detailed above in regard to the first embodiment are also attained.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described our invention, what we claim as new and desire to secure by Letters Patent is:

1. A fluid product holding and dispensing system comprising:

A. a fluid product retaining bottle comprising
  a. a product holding zone,
  b. a portal cooperatively associated with the holding zone for enabling the product to be dispensed therethrough, and
  c. sealing means cooperatively associated with the portal for sealing the portal to prevent passage of the product through the portal; and B. a product dispensing trigger assembly comprising
  a. a first mountable member comprising
    1. an engaging portion defining an internal cavity and constructed for mounted engagement with the bottle with the internal cavity thereof being in peripheral, surrounding relationship with the portal of the bottle,
    2. an elongated guide portion cooperatively associated with the engaging portion and defining an internal flow channel interconnected with the internal cavity of the engaging portion, and
    3. control means formed on the outside surface of the guide portion and constructed for cooperative engagement with channel means and lock means for providing a first and a second locked position between which the product dispensing trigger assembly is movable; and
  b. a second movable member cooperatively associated with the first member and comprising
    1. a body having an inside surface constructed for cooperative association with the guide portion of the first member for movement relative thereto from said first locked position to said second locked position, 2. an elongated, longitudinally extending tube member
   i. extending substantially the entire length of the body,
   ii. constructed for cooperative, telescopic, axially movable engagement with the internal flow channel of the guide portion, and
   iii. defining a central passageway for delivering the fluid product from the bottle through the second member,
3. puncture means mounted to the elongated axially extending tube member in cooperating relationship with the central passageway, and positioned in juxtaposed, spaced, cooperating relationship with the sealing means of the fluid retaining bottle in said first position, and movable into ruptured engagement with the sealing means when in said second locked position,
4. axially extending channel means formed in the inside wall of the body
   i. comprising a width substantially less than the circumference of the inside wall of the body,
   ii. constructed for slidably retaining the control means of the guide portion therein and controlling the axial movement of the second member relative to the first member, and
5. lock means formed in the channel means for cooperative interengagement with the control means for maintaining the second member relative to the first member in the two alternate locked positions, whereby a fluid product holding and dispensing system is attained which provides a first locked position wherein the bottle and contents thereof remain completely sealed and quickly and easily moved into a second position when the seal means are automatically ruptured and the fluid is capable of being dispensed therefrom.

2. The fluid product holding and dispensing system defined in claim 1, wherein said elongated guide portion is further defined as comprising a generally hollow cylindrical shape and the inside surface of the body of the second member is further defined as being constructed for peripheral, surrounding, cooperating, telescopic engagement with said elongated guide portion.

3. The fluid product holding and dispensing system defined in claim 2, wherein said fluid product retaining bottle is further defined as comprising a thread bearing collar peripherally surrounding and forming the portal thereof and said bottle engaging portion of the first member is further defined as comprising thread means constructed for cooperating, secure threaded interengagement with the thread means of the bottle, thereby providing a construction wherein said first member can be quickly and easily mounted in interengagement therewith.

4. The fluid product holding and dispensing system defined in claim 3, wherein said second member is further defined as comprising a dispensing surface formed thereon, constructed for receiving dispensing means for assisting in the transferral of the fluid from the central passageway to an application site desired by the user.

5. The fluid product holding and dispensing system defined in claim 1, wherein said elongated longitudinally extending tube member is further defined as comprising a hollow cylindrical shape substantially centrally mounted within the body of the second member in juxtaposed, spaced relationship with the inside surface of the body and comprising a diameter less than the diameter of the internal flow channel of the guide portion of the first member, thereby assuring axial, telescopic movement of the tube member within the internal flow channel.

6. The fluid product holding and dispensing system defined in claim 5, wherein said elongated hollow tube member is further defined as comprising the puncture means formed at one end thereof.

7. The fluid product holding and dispensing system defined in claim 6, wherein said elongated tube member is further defined as being aligned with the central passageway of the second member in juxtaposed, spaced relationship to the inside wall of the housing, defining an annular zone therebetween.

8. The fluid product holding and dispensing system defined in claim 7, wherein said elongated tube member is constructed for telescopic axial movement within said elongated guide portion of the first member, with the elongated guide portion of the first member being constructed for telescopic axial movement within the annular zone formed between the tube member and the inside wall of the housing, thereby assuring the desired movement of the control means of the first member in the channel means of the second member.

9. The fluid product holding and dispensing system defined in claim 1, wherein said second member is further defined as comprising two separate and independent axially extending channel means formed in the inside wall of the body substantially diametrically opposed from each other with each of said channel means comprising a width substantially less than the circumference of the inside wall of the body, and the first member is further defined as comprising two separate and independent control means, each having a width substantially less than the width of the outside surface of the guide portion thereof and dimensioned for cooperative, sliding interengagement with one of said channel means of said second member.

10. The fluid product holding and dispensing system defined in claim 9, wherein said lock means is further defined as comprising at least one finger member formed in one of said axially extending channel means radially extending therefrom and positioned for cooperative interengagement with one of said control means of the first member.

11. The fluid product holding and dispensing system defined in claim 10, wherein each of said control means is further defined as comprising a radially extending, rectangular-shaped block member incorporating a pair of radially extending ridges on one face thereof, said ridges being constructed for cooperative interengagement with the radially extending finger member to establish the two alternate locked positions of the second member relative to the first member.

12. The fluid product holding and dispensing system defined in claim 11, wherein the finger member forming the lock means is further defined as extending from the base of the channel means at an acute angle relative thereto, extending inwardly toward the centrally disposed tube member, with said finger member being further defined as being substantially rigid, while providing arcuate flexibility when sufficient force is applied thereto.

13. The fluid product holding and dispensing system defined in claim 12, wherein each of said ridges formed in the block member of the control means of the first member are further defined as comprising a ramped surface, a substantially flat, radially extending surface positioned in juxtaposed, spaced relationship to the ramped surface, and an intermediate surface extending between the ramped surface and the radially extending flat surface, whereby cooperative, controlled, interengagement with the locking finger is attained.

14. The fluid product holding and dispensing system defined in claim 12, wherein the pair of ridges formed in the control means are constructed for cooperative interengagement with the arcuately disposed, inwardly extending finger member for providing locking engagement of the finger member with each of radially extending flat surfaces of the ridges, providing the desired two alternate locked positions, with movement from the first position to the second position being resisted until sufficient force is applied by a ramped surface to deflect the finger member and enable the telescopic cooperative movement of the second member relative to the first member.

15. The fluid product holding and dispensing system defined in claim 1, wherein the control means formed on the outside surface of the guide portion of the first member is further defined as comprising two separate and independent, substantially rectangular shaped block members, each having a width substantially less than the width of the circumference of the outside surface of the guide portion, with said width being dimensioned for cooperative, sliding interengagement with the channel means, and said channel means formed on the inside wall of the body of the second member is further defined as comprising a pair of axially extending grooves formed in substantially opposed facing surfaces of the inside wall of the body, with each of said grooves comprising an overall width dimensioned for enabling cooperative, sliding, holding engagement of one of said block members, whereby the block members are capable of axial movement through said grooves, providing controlled movement of the second member relative to the first member between the two alternate positions thereof.

16. The fluid product holding and dispensing system defined in claim 15, wherein each of the grooves forming the axially extending channel means are further defined as comprising a substantially continuous, elongated, axially extending stepped configuration with said groove being defined by two cooperating offset groove portions with said portions being interconnected with each other at an intermediate juncture zone.

17. The fluid product holding and dispensing system defined in claim 16, wherein said lock means is further defined as comprising a pair of ribs formed in the base of each longitudinally extending groove with said ribs comprising a raised zone for providing resistance at each of the ribs to the longitudinal movement of the block member in the groove member, while enabling the block member to be moved passed the ribs, when desired by the application of sufficient force thereto, whereby the desired two alternate lock positions of the second member relative to the first member are provided.

18. A fluid product holding and dispensing system comprising:

A. a fluid product retaining bottle comprising
  a. a product holding zone,
  b. a portal cooperatively associated with the holding zone for enabling the product to be dispensed therethrough, and
  c. sealing means cooperatively associated with the portal for sealing the portal to prevent passage of the product through the portal; and B. a product dispensing trigger assembly comprising
  a. a first mountable member comprising
    1. an engaging portion defining an internal cavity and constructed for mounted engagement with the bottle with the internal cavity thereof being in peripheral, surrounding relationship with the portal of the bottle,
    2. an elongated guide portion cooperatively associated with the engaging portion and defining an internal flow channel interconnected with the internal cavity of the engaging portion, and
    3. two separate and independent control means formed on the outside surface of the guide portion and constructed for cooperative engagement with channel means and lock means for providing a first and a second locked position between which the product dispensing trigger assembly is movable, each of said control means
      i. having a width substantially less than the width of the outside surface of the guide portion thereof and dimensioned for cooperative, sliding interengagement with the channel means of said second member,
      ii. comprising a radially extending, rectangular-shaped block member incorporating a pair of radially extending ridges on one face thereof, said ridges being constructed for cooperative interengagement with a radially extending finger member to establish the two alternate locked positions of the second member relative to the first member; and b. a second movable member cooperatively associated with the first member and comprising
  1. a body having an inside surface constructed for cooperative association with the guide portion of the first member for movement relative thereto from said first locked position to said second locked position,
  2. an elongated, longitudinally extending tube member
    i. extending substantially the entire length of the body,
    ii. constructed for cooperative, telescopic, axially movable engagement with the internal flow channel of the guide portion, and
    iii. defining a central passageway for delivering the fluid product from the bottle through the second member,
  3. puncture means mounted to the elongated axially extending tube member in cooperating relationship with the central passageway, and positioned in juxtaposed, spaced, cooperating relationship with the sealing means of the fluid retaining bottle in said first position, and movable into ruptured engagement with the sealing means when in said second locked position,
  4. two separate and independent axially extending channel means formed in the inside wall of the body substantially diametrically opposed from each other, each of said channel means
    i. comprising a width substantially less than the circumference of the inside wall of the body,
    ii. constructed for slidably retaining the control means of the guide portion therein and controlling the axial movement of the second member relative to the first member, and
  5. lock means
    i. comprising at least one finger member formed in the base of one of said axially extending channel means radially extending therefrom at an acute angle thereto and positioned for cooperative interengagement with the ridges of one of said control means of the first member, and ii. being substantially rigid, while providing arcuate flexibility when sufficient force is applied thereto, whereby a fluid product holding and dispensing system is attained which provides a first locked position wherein the bottle and contents thereof remain completely sealed and quickly and easily moved into a second position when the seal means are automatically ruptured and the fluid is capable of being dispensed therefrom.

19. The fluid product holding and dispensing system defined in claim 18, wherein each of said ridges formed in the block of the control means of the first member are further defined as comprising a ramped surface, a substantially flat, radially extending surface positioned in juxtaposed, spaced relationship to the ramped surface, and an intermediate surface extending between the ramped surface and the radially extending flat surface, whereby cooperative, controlled, interengagement with the locking finger is attained.

20. The fluid product holding and dispensing system defined in claim 19, wherein the pair of ridges formed in the control means are constructed for cooperative interengagement with the arcuately disposed, inwardly extending finger member for providing locking engagement of the finger member with each of the radially extending flat surfaces of the ridges, providing the desired two alternate locked positions, with movement from the first position to the second position being resisted until sufficient force is applied by the ramped surface to deflect the finger member and enable the telescopic cooperative movement of the second member relative to the first member.

21. A fluid product dispensing trigger assembly constructed for mounted engagement with a conventional fluid product retaining bottle having a holding zone, a single portal and seal means associated with the portal for sealing the product in the holding zone, said trigger assembly comprising A. a first mountable member comprising a. an engaging portion defining an internal cavity and constructed for mounted engagement with the bottle with the internal cavity thereof being in peripheral, surrounding relationship with the portal of the bottle, b. an elongated guide portion cooperatively associated with the engaging portion and defining an internal flow channel interconnected with the internal cavity of the engaging portion, and c. control means formed on the outside surface of the guide portion and constructed for cooperative engagement with channel means and lock means for providing a first and a second locked position between which the product dispensing trigger assembly is movable; and B. a second movable member cooperatively associated with the first member and comprising a. a body having an inside surface constructed for cooperative association with the guide portion of the first member for movement relative thereto from said first locked position to said second locked position, b. an elongated, longitudinally extending tube member 1. extending substantially the entire length of the body, 2. constructed for cooperative, telescopic, axially movable engagement with the internal flow channel of the guide portion, and 3. defining a central passageway for delivering the fluid product from the bottle through the second member, c. puncture means mounted to the elongated axially extending tube member in cooperating relationship with the central passageway, and positioned in juxtaposed, spaced, cooperating relationship with the sealing means of the fluid retaining bottle in said first position, and movable into ruptured engagement with the sealing means when in said second locked position, d. axially extending channel means formed in the inside wall of the body 1. comprising a width substantially less than the circumference of the inside wall of the body, 2. constructed for slidably retaining the control means of the guide portion therein and controlling the axial movement of the second member relative to the first member, and e. lock means formed in the channel means for cooperative interengagement with the control means for maintaining the second member relative to the first member in the two alternate locked positions, whereby a fluid product holding and dispensing system is attained which provides a first locked position wherein the bottle and contents thereof remain completely sealed and quickly and easily moved into a second position when the seal means are automatically ruptured and the fluid is capable of being dispensed therefrom.

* * * * *